United States Patent [19]

MacDonald

[11] 4,176,419

[45] Dec. 4, 1979

[54] SWIMMING POOL CLEANING DEVICE

[76] Inventor: Malcolm D. MacDonald, 46 Dogwood Crescent, Scarborough, Ontario, Canada, M1P 3N6

[21] Appl. No.: 936,574

[22] Filed: Aug. 22, 1978

[51] Int. Cl.[2] ..... E04H 3/20

[52] U.S. Cl. ..... 15/1.7; 15/160

[58] Field of Search ..... 15/1.7, 160, 105; 210/169, 470, 407

[56] References Cited

U.S. PATENT DOCUMENTS

| | | | |
|---|---|---|---|
| 3,220,037 | 11/1965 | Ruhling | 15/1.7 |
| 3,273,187 | 9/1966 | Williams | 15/1.7 |
| 4,003,100 | 1/1977 | Whitaker | 15/1.7 |

*Primary Examiner*—Edward L. Roberts

*Attorney, Agent, or Firm*—Hirons, Rogers & Scott

[57] ABSTRACT

A swimming pool cleaning device comprises an elongated handle, a frame at one end of the handle, a skimming bag, e.g. a wire mesh or a nylon net mounted in the frame for skimming purposes, and brush bristles protruding laterally outwardly from the side surface of the frame. The device permits debris clinging to the sides and bottom of a pool to be freed, by use of the brush bristles, and then immediately caught in the skimmer for removal purposes.

7 Claims, 2 Drawing Figures

SWIMMING POOL CLEANING DEVICE

FIELD OF THE INVENTION

This invention relates to pool cleaning devices and more particularly to devices for skimming debris from open air swimming pools.

BACKGROUND OF THE INVENTION

The conventional swimming pool skimmer comprises an elongated handle, long enough so that the operator standing on the side of the pool can reach the center and bottom of the pool, a generally rectangular frame attached to one end of the handle, and a strainer such as a metal or fibre net screen or bag in the frame. Whilst such a skimmer might be quite adequate for removing freely floating or suspended debris from a swimming pool, it has its limitations in use. Pool debris such as leaves, twigs etc. tends to collect at the sides of the water surface, and to cling to the sides of the pool. The conventional skimmer is not effective in removing such debris from the sides, without scratching and marking the side tile surfaces of the pool. Also, after a period of time, some of the debris tends to become water-logged and sink, to rest on and even cling to the bottom surface of the pool, from where it is not effectively removed by the conventional pool skimmer. The professional pool maintainer normally conducts a separate, time consuming and tedious initial operation to free the debris from the sides of the swimming pool prior to using the conventional skimmer.

BRIEF DESCRIPTION OF THE PRIOR ART

U.S. Pat. No. 3,063,077 Pansini shows a catcher air-jet arrangement for removing leaves from a swimming pool. The embodiment shown in FIG. 4 is most suitable for collecting floating leaves from the water surface and the pool walls.

U.S. Pat. No. 3,863,237 Doerr shows a hand operated apparatus for cleaning up a lake or pond, having a ridged scoop attached to a long handle.

U.S. Pat. No. 3,667,611 Pansini shows a portable leaf trap which is used by placing it over the swimming pool drain on the floor of the pool so as to trap leaves approaching the drain.

U.S. Pat. No. 2,899,063 Ellis shows an aquarium cleaner which has a vacuum tube and is provided with brush attachments which can be put on the bottom of the vacuum tube so as to clean up the walls of the aquarium. It does not however included any skimming arrangement.

U.S. Pat. No. 3,132,364 Oxley shows a debris cleaner for swimming pools having a suction pump attachment and a strainer.

U.S. Pat. No. 3,220,037 Ruhling shows a swimming pool cleaning implement comprising a straining bag with an elongated handle attachment therefor.

SUMMARY OF THE INVENTION

It is an object of the present invention to provide a new and improved pool cleaning device.

The present invention provides a pool cleaning device which can be used manually both for freeing the debris from the sides and bottom of the pool, and for skimming the freed debris off the water. The device of the invention includes the normal elongated handle, frame and skimming net, but also includes brush elements protruding laterally from sides of the frame. In operation, therefore, sides of the pool can be brushed to clean them, debris can be freed from the side surfaces and immediately caught in the skimmer net and removed.

Thus according to the present invention there is provided a swimming pool cleaning device comprising an elongated handle, a frame attached to one end of the handle, flexible strainer means attached to and closing the aperture defined by said frame, and brush elements protruding laterally outwardly from said frame.

DESCRIPTION OF THE PREFERRED EMODIMENTS

In a preferred form of the invention, the frame of the device is rectangular, and the brush elements are secured to a similarly rectangular subframe, provided on its under surface with a groove into which the frame of the skimmer will fit as an interference fit. Thus, for the conventional, round section metal frame elements of a conventional skimming device, the subframe according to the invention is provided with a part circular aperture on its under side, into which the frame of the device is a snap fit. The subframe may be of plastic, with the bristles embedded therein at the time of its shaping and manufacture, so as to protrude laterally outwardly therefrom.

Also according to a preferred embodiment, the brush elements protrude from both of the shorter sides of the rectangular subframe, and from one only of the longer sides of the subframe. Then the handle is attached to the center of the long side free from bristles. The provision of bristles on the side adjacent the handle is not necessary. It is also preferred that the bristles protruding from the shorter, side surfaces be longer than the bristles protruding from the longer side of the rectangular subframe. Then the longer bristles are used for freeing the debris clinging to the side surfaces of the pool, for which purpose large amounts of friction are not required, but the gentler, resilient flexing action of longer bristles are to be preferred. The shorter bristles give a more thorough scrubbing action for use on the bottom surface of the pool, for cleaning purposes thereon.

BRIEF REFERENCE OF THE DRAWINGS

In the drawings, like reference numerals indicate like parts.

DETAILED DESCRIPTION OF THE SPECIFIC PREFERRED EMBODIMENT

Figure 1:
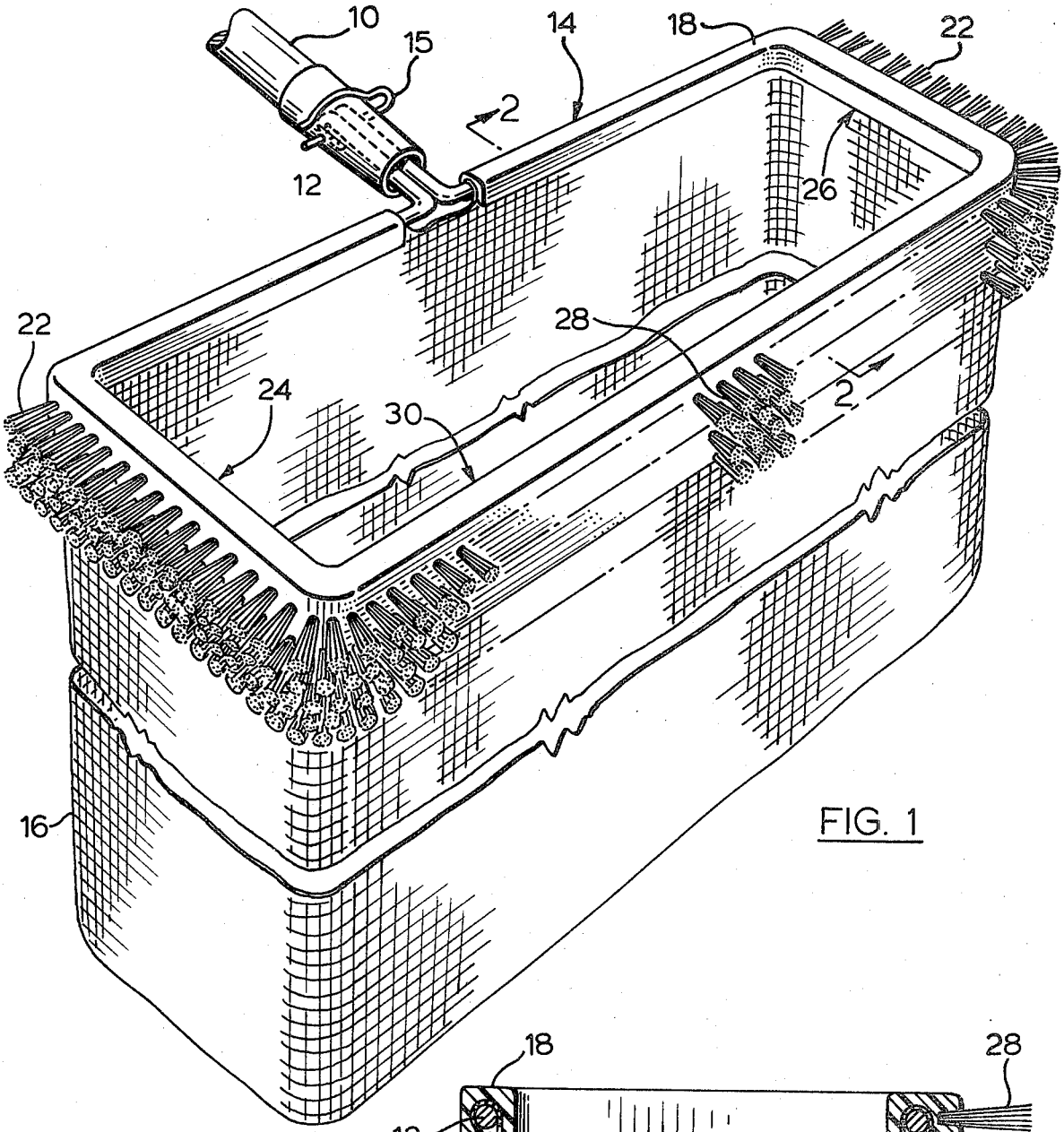
FIG. 1 is a perspective view, with parts cut away, of a pool cleaning device according to the invention.

The device as illustrated includes an elongated handle 10 and a generally rectangular frame 12. The frame 12 is formed of circular section metal, ie. aluminum extrusion, as one continuous piece, the free ends of which come together at the center of one of the longer sides 14 of the rectangle, where they form the handle attachment means, and protrude into the hollow end of the handle 10 to be releasably secured therein, by means of clips 15.

A strainer in the form of a flexible nylon net bag 16 is secured at its upper edge to the frame 12, so as to depend therefrom, for skimming of the water surface and collection of debris from the pool, in use. The bag 16 effectively closes the rectangular aperture defined by the frame 12.

Figure 2:
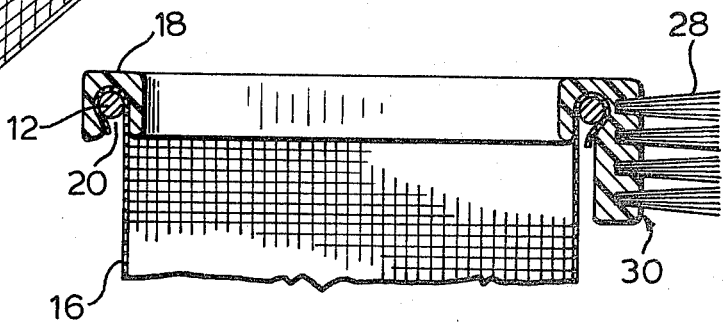
FIG. 2 is a sectional view along the line 2—2 of FIG. 1.

A subframe 18 is provided, which fits over the metal frame 12 and clamps the edge of the bag 16 to secure it releasably in position. The subframe 18 is of plastic, and is of generally rectangular shape to coincide with the shape of the frame 12, with a gap provided at the middle of one of its longer sides 14 of the rectangle, to accomodate the handle attachment. As best seen in FIG. 2, the plastic subframe 18 has a groove 20 in its underside, extending around its entire length, the groove 20 being shaped to form in section more than half a circle. The circular section metal frame 12 is a snap fit within the groove 20, and serves to clamp the top edge of the bag 16 in position, between the metal frame 12 and the subframe 18.

Flexible brush bristles are secured to the subframe 18 to extend laterally outwardly from the outer face thereof. The sets of bristles 22 protruding from the shorter sides 24, 26 are relatively long, namely about ¾ of an inch. Another set of bristles 28 of shorter length, namely about a half inch, protrude from the longer side 30 of the subframe 18. No bristles protrude from longer side 14 adjacent the handle. The bristles are arranged in clusters as in a conventional scrubbing brush and are relatively stiff. They are secured in position by being embedded in the plastic of the subframe 18 at the time it is shaped.

In the device as illustrated, the parts can be readily dissembled for repair and relacement when necessary. The metal frame 12 is a interference fit in the hollow end of the handle 10, and is held therein by means of releasable clips 15. Removal of the handle from the frame facilitates storage of the device when out of use. The subframe 18 is an interference fit over the frame 12, and can be removed therefrom by resilient flexing of the plastic from which it is made. When the subframe 18 and the frame 12 are separated, the nylon strainer bag 16 can be removed.

It is also within the scope of the present invention to provide a brush element attachment in the form of the illustrated subframe 18 with bristle sets 22, 28 and securing groove 20, for attaching to a pre-existing pool skimmer having a generally rectangular frame of appropriate shape and dimensions.

The device of the invention permits thorough cleaning of a swimming pool and the like by manual means. Debris and dirt clinging to the sides of the pool can be released by the brushing action of the bristles protruding outwardly from the frame, and then caught in the net for removal in the conventional way. A separate operation to release the debris from the sides, prior to skimming, is rendered unnecessary. Similarly the device can be used to free debris adhering to the bottom of the pool, to allow it to rise to a limited extent so as to be caught in the skimming net. Stains and the like can also be removed from the pool sides and bottom by use of the brush elements. The device is simple to manufacture and operate. The brush elements are light in weight, and do not render the device excessively heavy or cumbersome to operate. Suitable light plastic materials for making the subframe include polyethylene, polypropylene, impact polystyrene, A.B.S. resin, vinyl resin and the like.

It will be appreciated that the embodiments of the invention described in detail and illustrated herein are exemplary only, and are not to be construed as limiting. The scope of the invention is limited only by the appended claims.

I claim:

1. A swimming pool cleaning device comprising:
an elongated handle;
a frame attached to one end of the handle, said frame defining an aperture;
flexible strainer means attached to and closing the aperture defined by said frame;
brush elements protruding laterally outwardly from said frame.

2. The pool cleaning device of claim 1 wherein the frame has pairs of the opposed mutually parallel sides, one pair extending parallel to the length of the elongated handle, another pair extending transversely thereto, the handle being attached intermediate the ends of one of said transversely extending sides.

3. The pool cleaning device of claim 2 wherein the frame is generally rectangular, the handle being attached near the center of one of the longer sides thereof.

4. The pool cleaning device of claim 3 wherein the brush elements comprise flexible bristles, protruding laterally outwardly from the two shorter sides of the rectangular frame, and from the longer side opposed to the handle attachment.

5. The pool cleaning device of claim 4 wherein the bristles protruding from the shorter sides are longer than the bristles protruding from the longer side.

6. The pool cleaning device of claim 5 wherein the brush elements further include a sub-frame to which the flexible bristles are attached, said subframe being shaped and dimensioned to interfit with the frame, and being releasable therefrom so as to remove the brush elements from the device.

7. A brush element for releasable attachment to the rectangular frame of a pool skimming device of the type having a strainer closing the aperture in said rectangular frame, the brush element including;
a generally rectangular subframe shaped and dimensioned to coincide with the frame of the skimming device, a first, longer side of said generally rectangular subframe having a gap in its length near the mid-point thereof;
a groove extending around the underside of said subframe adapted to receive therein as an interference fit the frame of the pool skimmer;
brush elements protruding laterally outwardly from the second longer side face and both the shorter side faces of said rectangular subframe.

* * * * *